United States Patent [19]

Hafner

[11] Patent Number: 4,686,388

[45] Date of Patent: Aug. 11, 1987

[54] INTEGRATED CIRCUIT SUBSTRATE BIAS SELECTION CIRCUIT

[75] Inventor: Warren G. Hafner, Lake Carmel, N.Y.

[73] Assignee: Pitney Bowes Inc., Stamford, Conn.

[21] Appl. No.: 710,801

[22] Filed: Mar. 12, 1985

[51] Int. Cl.[4] ..... G05F 3/16

[52] U.S. Cl. ..... 307/296 R; 307/200 B; 307/363; 307/496

[58] Field of Search ..... 307/200 B, 494, 496–497, 307/355, 360, 363, 579, 585, 296 R, 297

[56] References Cited

U.S. PATENT DOCUMENTS 4,324,991 4/1982 Tamaki ..... 307/579 X
4,463,270 7/1984 Gordon ..... 307/200 B X
4,473,758 9/1984 Huntington ..... 307/296 R
4,499,388 2/1985 Adam ..... 307/585 X
4,556,804 12/1985 Dewitt ..... 307/200 B X

*Primary Examiner*—Stanley D. Miller
*Assistant Examiner*—D. R. Hudspeth
*Attorney, Agent, or Firm*—Michael J. DeSha; David E. Pitchenik; Melvin J. Scolnick

[57] ABSTRACT

A circuit for selecting one of a plurality of positive voltages when both can be applied to an integrated circuit. The circuit comprises a sensing apparatus for determining which of the plurality of voltages is the highest, apparatus for providing the highest voltage to the substrate and apparatus for applying the highest of the plurality of voltages to the substrate to insure protection and proper operation of the integrated circuit.

4 Claims, 1 Drawing Figure

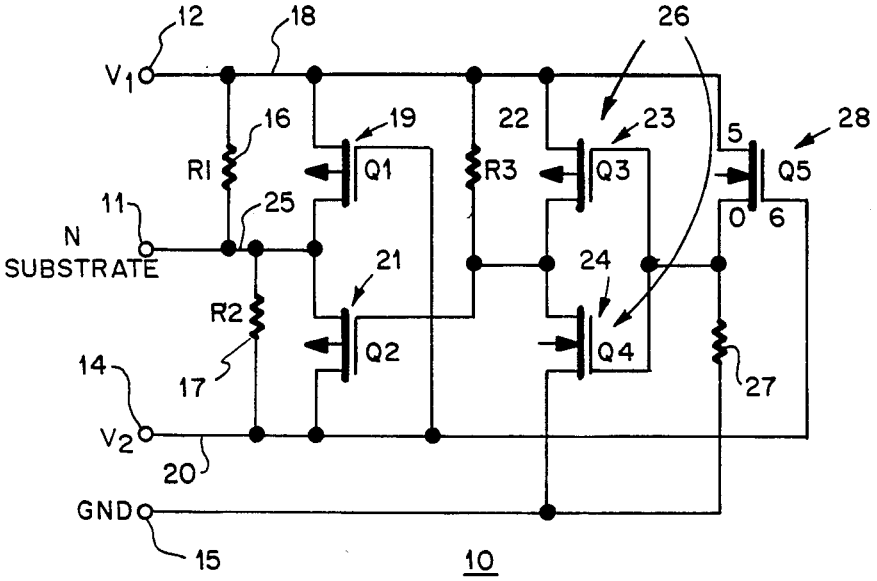
12
18
26
V1
16
19
22
23
5
28
R1
Q1
R3
Q3
Q5
11
25
0
6
N
SUBSTRATE
21
24
R2
Q2
Q4
14
17
27
V2
20
GND
15
10

INTEGRATED CIRCUIT SUBSTRATE BIAS SELECTION CIRCUIT

FIELD OF THE INVENTION

The present invention relates to bias selection circuitry and more particularly the invention relates to circuits which are of special utility and insure that the proper voltage is applied to the substrate of C-MOS or a like device.

BACKGROUND OF THE INVENTION

It is well known that C-MOS devices require power supplies for their proper operation. It is also well recognized that often times there is more than one positive voltage applied to the circuit at any one time. It is also true that, in those types of devices, more than one positive voltage can be applied at any time, those two voltages can be at different levels. More particularly, in certain C-MOS technologies it is important that the voltage applied to the substrate be the higher of any two levels of voltage applied thereto. If the higher voltage is not applied to the substrate then the P-N junction formed by the N-substrate and a P-diffusion will be forward biased, and the resulting current may cause the device's circuitry to latch up. The latch up condition, if maintained on the C-MOS device, could draw excessive current from the power supply associated with the device and also potentially destroy the integrated circuit employed in the C-MOS circuitry.

In U.S. Pat. No. 4,473,758 issued on Sept. 25, 1984 in the name of Robert C. Huntington, a substrate bias control circuit and method are disclosed. This patent describes a substrate bias voltage control circuit that insures that a substrate has a supply of voltage applied thereto which includes a means of providing sources of bias and supply voltage to the substrate. The apparatus as described in the above-mentioned patent also provides a means for coupling the bias voltage to the substrate when the bias voltage is present and then if the bias voltage is not present it provides for means for coupling the supply voltage to the substrate. Although this device works properly for its intended purpose, it does not address the problem of insuring that the highest voltage being applied to the device is in turn also applied to the substrate. It, in effect, selects a bias voltage whenever it is present irrespective of whether it is higher or lower than the supply voltage applied thereto.

Accordingly, what is needed is apparatus and methods for the C-MOS device preventing a higher voltage being applied to the device than that applied to the substrate. What is also needed is circuitry to insure that the protection to the device is provided in a reliable manner.

SUMMARY OF THE INVENTION

An integrated circuit substrate bias selection circuit is disclosed in the present invention. In accordance with an embodiment of the present invention, the bias selection circuit comprises means for providing a plurality of voltages to the substrate of the integrated circuit, means for sensing which of the plurality of voltages is the highest, and means for applying the highest of the plurality of voltages to the substrate. This embodiment advantageously uses a C-MOS device that can have two positive voltages applied thereto. This embodiment also utilizes a resistor pair as a voltage divider to further minimize the differences between the first and second voltages. These resistors allow for the use of higher threshold transistors when utilizing the present invention.

Therefore, by the use of this control circuit protection of the C-MOS device is ensured by providing only the highest voltage to the substrate of the device. In so doing, the device is not in danger of being destroyed by excess voltage thereon, and insures prevention of any latch up condition on the C-MOS device.

BRIEF DESCRIPTION OF THE DRAWINGS

A schematic circuit diagram of a substrate bias selection circuit in accordance with the present invention is illustrated in the drawing.

DETAILED DESCRIPTION

Referring to the drawing, a substrate bias selection circuit, in accordance with the present invention, is illustrated generally at 10; as part of an integrated circuit. A first voltage supply terminal 12 receives a supply voltage V-1 for the integrated circuit device. A second supply voltage V-2 terminal 14 receives a supply voltage for the integrated circuit device. The voltage supplies 12 and 14 may be of any positive voltage, within the maximum voltage ratings of the device. As can be seen, an N-substrate terminal 11 is electrically connected to the first supply voltage 12 via resistor 16 and the substrate is connected to the second voltage supply V-2 14 through resistor 17.

A C-MOS implementation with an N-substrate is shown in the schematic diagrams. As is seen, the resistor 16 is electrically connected to the source of P-channel MOSFET 19 over line 18. The other end of the resistor 16 is electrically connected to the drain of the MOSFET 19 over line 25 and as stated before is connected to the N-substrate voltage terminal 11. As is also seen, one end of resistor 17 is electrically connected to one end to the resistor 16, the N-substrate 11, the drain of the MOSFET 19 and the drain of P-channel MOSFET 21. The other end of resistor 17 is connected over line 20 to the source of the P-channel MOSFET 21.

The gate of MOSFET 19 is electrically connected through line 20 to voltage supply 14. The gate of MOSFET 21 is electrically connected through resistor 22 to line 18 to voltage supply 12. The gate of MOSFET 21 is also electrically connected to an inverter pair designated generally as 26. The inverter pair 26 comprises an N-channel MOSFET 24 which is electrically coupled to a P-channel MOSFET 23. The gates of the MOSFET 23 and 24 are electrically coupled to each other and the drain of MOSFET 24 is electrically coupled to the drain of MOSFET 23. The source of MOSFET 23 is electrically coupled through line 18 to voltage terminal 12. The source of MOSFET 24 is electrically connected to ground.

The gates of MOSFETs 23 and 24 are electrically connected to resistor 27 to ground and the gates are also connected to the drain of an N-channel MOSFET 28. The source of the MOSFET 28 is connected over line 18 to voltage terminal 12 and the gate of the MOSFET 28 is connected to the voltage terminal 14.

The substrate bias selection circuit operates in the following manner. The resistors 16 and 17 act as voltage dividers to keep the N-substrate terminal 11 at some halfway point between the two voltages V1 and V2. That is if for example the voltage at terminal 12 was 5 volts and the voltage at terminal 14 was 10 volts then the voltage at the N-substrate terminal 11 would be no more than 7.5 volts. This difference is a bigger one than would normally be seen because of the operation of the bias selection circuit. However, the function of the resistors 16 and 17 is to minimize the difference between the two voltages at terminals 12 and 14 as seen at substrate terminal 11.

Initially if the voltage supplied at terminal 12 is higher than that at terminal 14, MOSFET 19 will be turned on which will short terminal 12 to the substrate. Thus, the voltage on the substrate will be approximately the voltage at terminal 12. To prevent a direct short between terminals 12 and 14, MOSFET 21 should be turned off. This is accomplished by pulling the gate of MOSFET 21 up through the voltage at terminal 12 via resistor 22. This will turn MOSFET 21 off because the gate voltage is higher than the source voltage of MOSFET 21.

Referring to MOSFET 28, if the voltage at terminal 14 is lower than the voltage at terminal 12, MOSFET 28 will be off because the voltage at the gate of the MOSFET 28 will be less than the voltage at the source. Therefore, at this time the point at the drain of MOSFET 28 is low and the output of the inverter pair 23 and 24 will be pulled high. The output of the inverter pair will in turn cause MOSFET 21 to be turned off ensuring there will not be a direct short across terminals 12 and 14. Thus, in the condition that the voltage at terminal 12 is greater than at terminal 14 the circuitry will always ensure that the N-substrate terminal 11 will be at the voltage of terminal 12. As voltage at terminal 14 approaches that at terminal 12, MOSFET 19 starts turning off and the resistors 16 and 17 start working to help minimize the differences between the voltages at the two terminals.

To prevent a direct short between terminals 12 and 14 MOSFET 19 should be turned off. This is accomplished by pulling the gate up through the voltage at terminal 14. Accordingly, the MOSFET 19 will be turned off because the gate voltage is higher than the source voltage of the MOSFET 19.

When voltage at terminal 14 starts exceeding that at terminal 12, MOSFET 28 will start turning on because the gate voltage is higher than the source voltage of the MOSFET 28. As the MOSFET 28 turns on it will begin to pull the drain of the MOSFET 28 high. With the drain of MOSFET 28 high the inverter pair 26 will produce a low signal. This low signal will in turn turn on MOSFET 21 and thus there will be a direct short to terminal 14 through MOSFET 21. Thus, when voltage at terminal 14 is greater, it will provide the voltage on the substrate and voltage on terminal 12 will be isolated from the substrate.

Accordingly through the use of this bias selection circuitry there is never a direct short between the terminals 12 and 14. As is seen, the only direct connection between the two terminals will be through the resistors 16 and 17. This circuit effectively ensures that in the case that there is more than one voltage applied to the C-MOS device only the highest voltage is applied to the substrate at any particular time. Thus, the device may operate normally with a plurality of positive voltages being supplied, with any one of these voltages being the highest at any given time, by the use of the selection circuitry. Accordingly, it is readily apparent that although only two voltages are applied in this embodiment more could be present on the device and this circuitry could be modified to select the highest voltage from several different voltages.

This circuit may be particularly useful in circuitry that is sensitive to system power and power down sequences. It is also readily seen that although N-channel and P-channel MOSFET devices were utilized in this illustrative embodiment that one ordinarily skilled in the art could use equivalent devices and still be within the scope and spirit of applicant's invention. Finally, it is readily apparent that although this invention has been described in conjunction with C-MOS integrated circuit technology, the invention could be utilized with other integrated circuit technologies and still be within the spirit and scope of applicant's invention.

The above described embodiment can be modified in a variety of ways and those modifications would still be within the spirit and scope of applicant's invention. Thus, while this invention has been disclosed by means of this specific illustrative embodiment, the principles thereof are capable of a wide range of modification by those skilled in the art within the scope of the following claims.

What is claimed is:

1. In an integrated circuit including a substrate connected thereto, a substrate bias selection circuit, the substrate bias selection circuit comprising:

means for providing a first and second voltage and a reference voltage to the integrated circuit, means coupled to the providing means for sensing whether the first or the second voltage applied to the circuit is higher, said sensing means including a first and second MOSFET circuit means, each said first and second MOSFET circuit means a first P-channel MOSFET respectively connected in parallel with a registor, and means coupled to the sensing means for applying the higher of the first or second voltages to the substrate.

2. The bias selection circuit of claim 1 in which the sensing circuit further includes an inverter means coupled to the first and second MOSFET circuit means.

3. In an integrated circuit including substrate connected thereto, a substrate bias selection circuit, the substrate bias selection circuit comprising:

means for providing a plurality of voltages including a reference voltage to the integrated circuit, means coupled to the providing means for sensing which of plurality of the voltages applied to the circuit is highest, means coupled to the sensing means for applying the highest of the plurality of voltages to the substrate, said sensing means including a first and second MOSFET circuit means, and the first and second MOSFET circuit means each respectively including a first P-channel MOSFET connected parallel with a resistor.

4. The bias selection circuit of claim 3 in which the sensing circuit further includes an inverter means coupled to the first and second MOSFET circuit means.

* * * * *